US005195345A

United States Patent [19]

Porombka et al.

[11] Patent Number: 5,195,345

[45] Date of Patent: Mar. 23, 1993

[54] REVERSING TWO-HIGH SECTION ROLLING MILL STAND

[75] Inventors: Burkhard Porombka, Grevenbroich; Michael Minnerop, Düsseldorf, both of Fed. Rep. of Germany

[73] Assignee: SMS Schloemann Siemag Aktiengesellschaft, Dusseldorf, Fed. Rep. of Germany

[21] Appl. No.: 924,434

[22] Filed: Jul. 31, 1992

Related U.S. Application Data

[63] Continuation of Ser. No. 821,860, Jan. 15, 1992, abandoned, which is a continuation of Ser. No. 548,289, Jul. 3, 1990, abandoned.

[30] Foreign Application Priority Data

Jul. 4, 1989 [DE] Fed. Rep. of Germany ..... 3921928

[51] Int. Cl.[5] ..... B21B 31/12

[52] U.S. Cl. ..... 72/237; 72/239; 72/250

[58] Field of Search ..... 72/221, 237, 238, 239, 72/247, 250

[56] References Cited

U.S. PATENT DOCUMENTS

| | | | |
|---|---|---|---|
| 1,488,909 | 4/1924 | Diehl | 72/250 |
| 1,891,579 | 12/1932 | Schreck | 72/250 |
| 3,459,023 | 8/1969 | Adair | 72/238 |
| 3,546,912 | 12/1970 | Stinnertz | 72/238 |
| 3,712,102 | 1/1973 | Eibe | 72/238 |

FOREIGN PATENT DOCUMENTS

| | | | |
|---|---|---|---|
| 0040584 | 11/1981 | European Pat. Off. | 72/238 |
| 911602 | 5/1954 | Fed. Rep. of Germany . | |
| 0170523 | 7/1989 | Japan | 72/239 |

*Primary Examiner*—Lowell A. Larson
*Assistant Examiner*—Thomas C. Schoeffler
*Attorney, Agent, or Firm*—Anderson Kill Olick & Oshinsky

[57] ABSTRACT

A reversing two-high sectional rolling mill stand with multiple pass rolls whose bearing members are adjustably guided in windows of posts of the rolling mill stand. The rolling mill stand is arranged together with additional rolling mill stands of the same type adjacent to each other in series transversely to the rolling direction. The rolls can be connected to drive units or to drive transmission elements arranged between the rolls of adjacent rolling mill stands. Adjustable and fixable guide members for the rolled material are arranged on both sides of the rolling gaps for each of the rolls. The guide members are adapted for the section passes and are mounted jointly on support members which can be connected to the rolling stand. Connecting tops are hinged to the beams of the rolling mill stand and can be slid upwardly and pivoted outwardly for removing the roll. The bearing members of the rolls are placeable into a support frame which can be placed between the beams of the stands and can be moved out from between the beams. The support members of the guide members for the rolled material can be placed in the support frame.

4 Claims, 2 Drawing Sheets

REVERSING TWO-HIGH SECTION ROLLING MILL STAND this is a continuation of application Ser. No. 07/821,860 filed Jan. 15, 1992, abandoned which is a continuation application of Ser. No. 07/548,289, filed Jul. 3, 1990, abandoned.

BACKGROUND OF THE INVENTION

1. Field of the Invention

The present invention relates to a reversing section rolling mill stand with multiple pass rolls whose bearing members are adjustably guided in windows of the posts of the rolling mill stand. The rolling mill stand is arranged together with additional rolling mill stands of the same type adjacent to each other in series transversely to the rolling direction. The rolls are connectable at both end faces thereof with drive units or with drive transmission elements arranged between the rolls of adjacent rolling mill stands. For each of the rolls of the pairs of rolls, special adjustable and fixable guide members for the rolled material are arranged on both sides of the rolling gap; the guide members being adapted for the section passes and being mounted jointly on support members which are connectible to the rolling mill stand.

2. Description of the Related Art

Reversing two-high section rolling mill stands of the above-described construction and arrangement are used for rolling various types of sections by feeding the rolled material in successive passes in a reversing manner initially to the passes of one rolling mill stand and subsequently to the passes of the adjacent rolling mill stand of the series. The rolling mill stands of a series are driven by a drive unit which is coupled to the rolling mill stand forming the beginning of a series. The driving force is transmitted through the rolls of the stand to the rolls of the next stand of the series through drive transmission elements which couple the rolls of the two stands with each other.

The guide members for the rolled material provided for the individual rolls of the stands, i.e., for the upper rolls and the lower rolls of the rolling mill stands, are arranged on rest bars which are fixedly connected to the beams of the rolling mill stands. The guide members must be adjusted prior to the beginning of the rolling process to the path of the roll to which they are assigned and usually remain in this adjusted position until the rolling mill stands are to be converted for rolling different sections. This conversion is effected by exchanging the sets of rolls of all rolling mill stands against other sets of rolls. For exchanging the sets of rolls, the guide members for the rolled material must be moved out of their adjusted position, either by completely disassembling the guide members or by pivoting or displacing the guide members on the rest bar, so that they are moved out of the path of movement of the rolls when the rolls are disassembled. The complete removal of the guide members is particularly unavoidable if different types of guide members are required for the passes of the new rolls to be used.

In addition to the above-described operations, an exchange of the rolls additionally requires that the remaining fittings necessary for carrying out the rolling process are released and disassembled or at least moved out of the path of movement of the rolls when the rolls are exchanged. Such fittings are, for example, devices for supplying cooling water, for pass lubrications, etc. After the new sets of rolls have been mounted, it is then necessary to reassemble the guide members for the rolled material or to place the guide members again into the operating position, to exactly adjust the guide members and also return the above-mentioned additional fittings into the operating positions. These operations are very time-consuming and, since they must be carried out on the rolling mill stands which are in the rolling position, they result in a long interruption of the rolling operation.

In the above-described construction and arrangement of two-high section rolling mill stands, the replacement of the sets of rolls also requires a relatively long time and also experience because the sets of rolls including the bearing members cannot easily be moved in and out of the posts of the stands through the windows thereof. The stands of a series are mounted relatively closely together and, thus, impair the removal of the sets of rolls. As a rule, after releasing the connections with the drive unit and the drive transmission elements, initially the bearing members must be pulled from the ends of the rolls and the rolls must be pulled inclined tilted upwardly out of the respective window and above the adjacent stand.

SUMMARY OF THE INVENTION

It is, therefore, the primary object of the invention to improve the reversing two-high section rolling mill stand intended for the above-described arrangement in such a way that the positioning and adjusting operations of the guide members for the rolled material and the additional fittings are simplified, that the idle times caused by the operations are substantially shortened and the exchange of the sets of rolls is also simplified, and the time required for the exchange is reduced.

In accordance with the invention, the rolling mill stands have conventional connecting tops which are hinged to the beams of the posts of the rolling mill stands and can be slid upwardly and pivoted outwardly for removing the rolls. The bearing members of the pairs of rolls are placeable into a support frame which can be placed between the beams of the stands and can be moved out from between the beams. The support members of the guide members for the rolled material can be placed in the support frame.

The above-described features of the rolling mill stand, according to the present invention, make it possible to lift the pairs of rolls with the bearing members and together with the guide members for the rolled material upwardly out of the rolling mill stands and to exchange them for other sets of rolls, wherein the guide members for the rolled material remain in the position adjusted for the rolling operation. The time-consuming adjustment of the guide members for the rolled material can be previously carried outside of the rolling mill stand. It is merely necessary to place the complete set of rolls with finally adjusted guide members for the rolled material from the top into the rolling mill stand and to connect the additional fittings before starting the new rolling process. The assembly and disassembly of the sets of rolls is no longer impaired by the rolls of adjacent stands.

In accordance with another feature of the present invention, the support frame may be a pair of U-shaped plates which are connected to each other through spacer members and whose surfaces extend parallel to each other. Each plate has a U-shaped recess which is open toward the top in the mounted position. The bearing members of the rolls can be inserted into the U-shaped recesses. When the bearing members are inserted, the flanges of the U-shaped plates guide the bearing members. The web portions of the U-shaped recesses form support surfaces for the bottom sides of the bearing members of the lower rolls. The pairs of plates additionally have oppositely located slot-like recesses for the insertion and displacement of the support members of the guide members for the rolled material.

The pairs of plates may have oppositely located projections which extend into the opening of the U-shaped recess. The upper corners of the bearing members of the upper rolls may act against the projections, so that, when the upper roll is lifted, the support frame formed by the pair of plates is lifted together with the roll.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
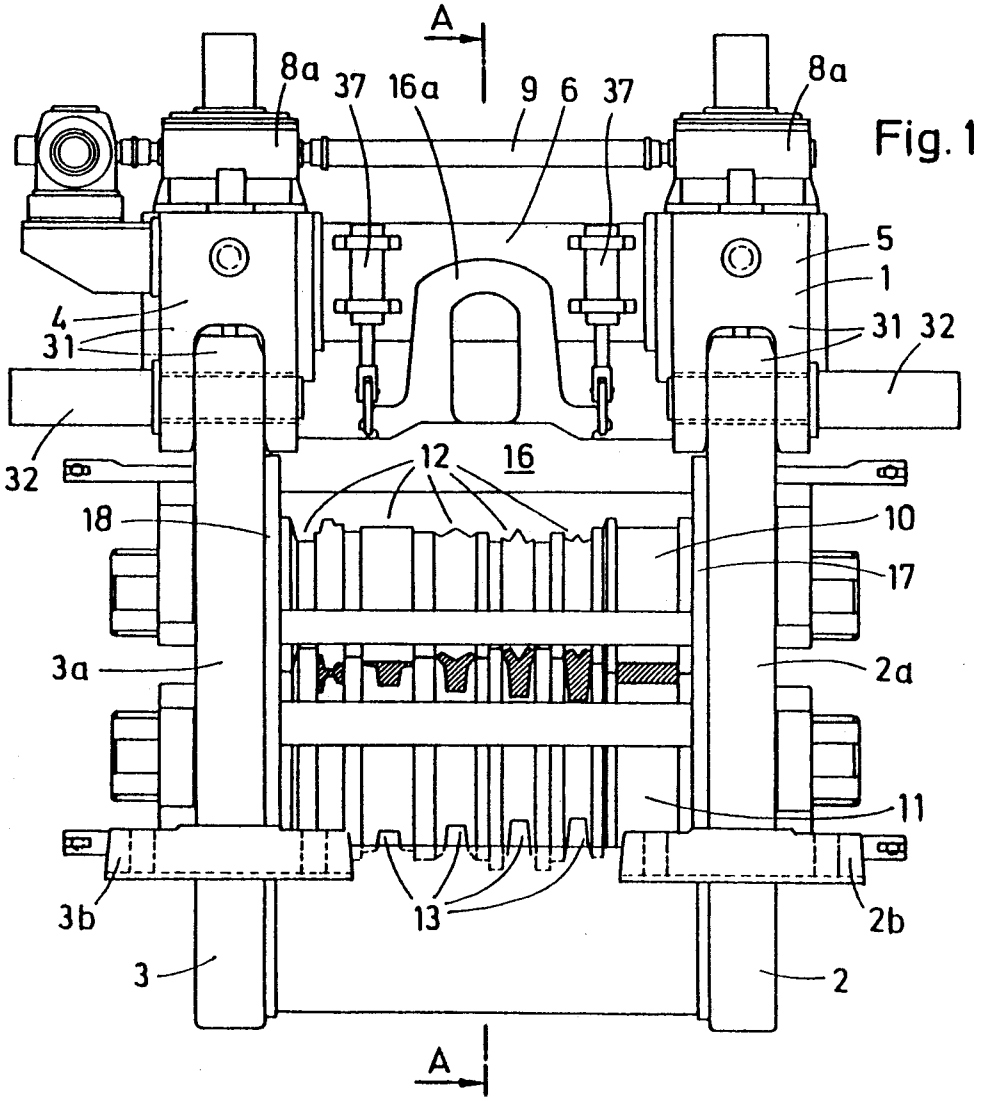
FIG. 1 is a view of the rolling mill stand seen in rolling direction.

As illustrated in FIG. 1 of the drawing, the rolling mill stand 1 is formed by posts 2 and 3 with beams 2*a*, 3*a* and connecting tops 4 and 5. The connecting tops 4 and 5 are rigidly connected to each other through a cross-beam 6. Adjusting spindles 7 are threadedly guided in spindle nuts 8 in the connecting tops 5. The spindles are driven jointly through adjusting gear units 8*a* which are arranged on the connecting tops 5 and which are coupled to each other through a connecting shaft 9.

As shown in FIG. 1, the upper and the lower rolls of the two-high roll set have six grooves each which together form six rolling passes, indicated by shadings.

Figure 2:
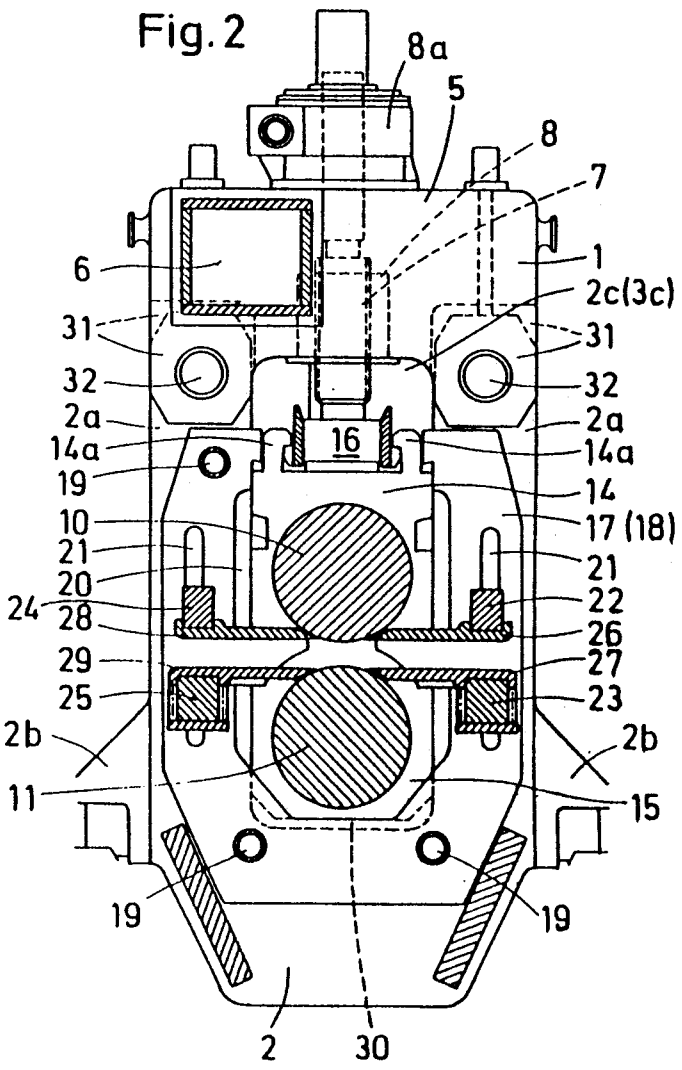
FIG. 2 is a sectional view taken along sectional line A—A of FIG. 1.

As can be seen in FIG. 2, the bearing members 14 of the upper roll 10 and the bearing member 15 of the lower roll 11 are guided in windows 2*c* and 3*c*, respectively, provided in the beams 2*a*, 3*a*. The bearing members 14 are suspended with hook-like projections 14*a* from a lifting girder 16 which is provided with a lifting eye 16*a*. The lifting girder 16, in turn, is suspended from lifting cylinders 37 which are connected to the cross-beam 6. The adjusting spindle 7 acts on the lifting girder 16. The lower roll 11 is guided with its bearing member 15 also in the windows 2*c* or 3*c* of the posts 2 and 3, respectively.

Figure 3:
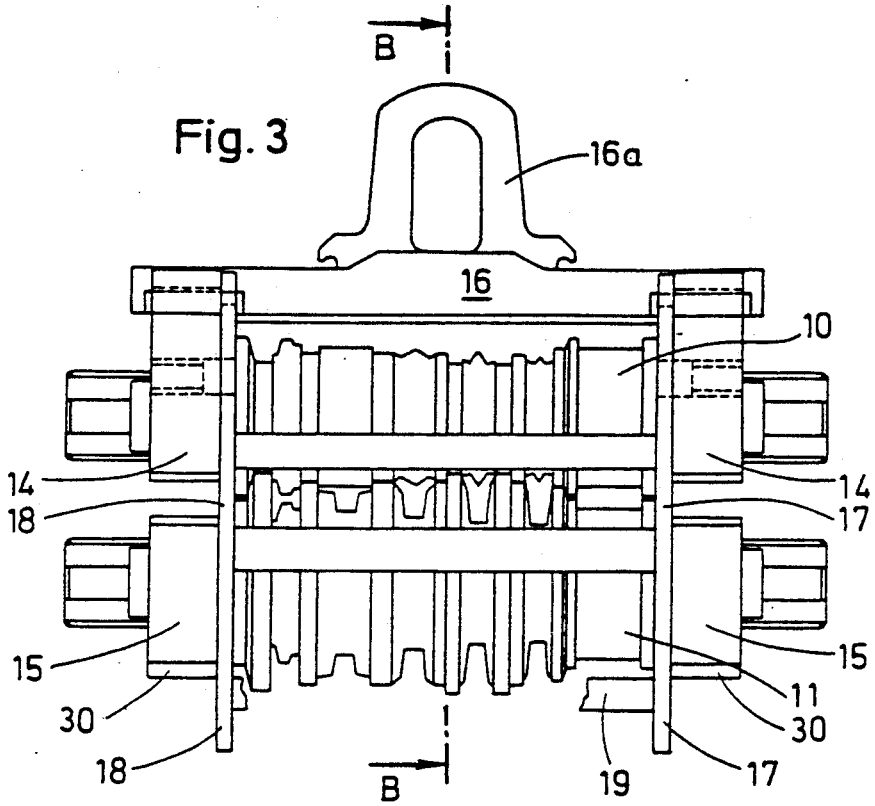
FIG. 3 shows a detail of the rolling mill stand of FIG. 1.

As can further be seen from FIGS. 1 and 2 in connection with FIG. 3, a support frame is placed between the two posts 2 and 3. The support frame is composed of plates 17 and 18 whose surfaces extend parallel to each other and includes spacer rods. Each of the plates 17 and 18 has a U-shaped recess 20 into which the bearing members 14 and 15 of the two rolls 10 and 11 can be inserted, while the flange portions of the plates 17 and 18 guide the bearing members 14 and 15. The bottom sides of the bearing members 15 of the lower roll 11 rest on the upwardly directed surfaces of the web portions of the U-shaped recess 20. In addition, both plates 17 and 18 have slot-like recesses 21 which are located opposite each other in the mounted state. Rest bars 2, 23 and 24, 25 arranged in front of the inlet and outlet side of the rolling gaps and the respective rolls are slidably guided and fixable in the slot-like recesses 21. As shown in the drawing, six guide members, 26 or 27 or 28 or 29, are adjustably and fixably arranged on the individual rest bars.

Figure 4:
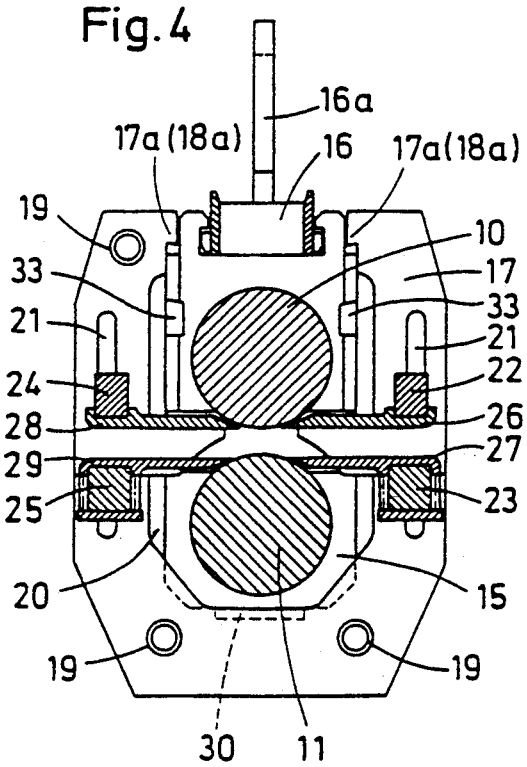
FIG. 4 is a sectional view taken along sectional line B—B of FIG. 3.
Figure 5:
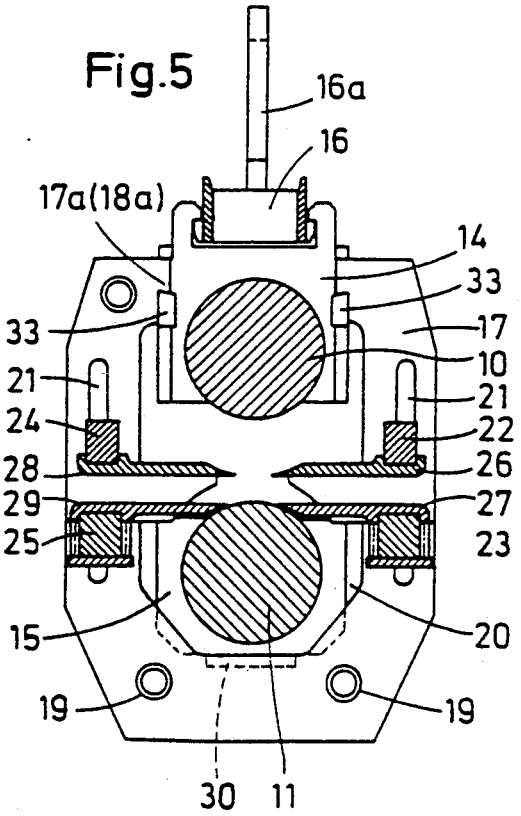
FIG. 5 shows the detail of FIG. 4 in a different position of operation of the rolling mill stand.

As illustrated in FIGS. 3, 4, and 5, outwardly directed cantilever projections 30 are mounted in the web portion of the U-shaped recesses 20 of the plates 17, 18. The cantilever projections 30 have downwardly facing surfaces which are placeable on the lower borders of the windows 2*c*, 3*c* of the posts 2, 3, as is also shown in FIG. 2. As particularly shown in FIGS. 3, 4 and 5, the pairs of plates 17, 18 in connection with the lifting girder 16 hold and support the roll set which is ready for operation and includes the upper roll 10, the lower roll 11, the bearing members 14 and 15, the rest bars 22, 23, 24, 25 and the sets of guide members 26, 27, 28, 29 for the rolled material which are mounted and positionally adjusted on the rest bars.

In the rolling position illustrated in FIGS. 1 and 2, the roll set can be lifted outwardly, for example, by means of a crane, out of the rolling mill stand 1 between the posts 2*a*, 3*a* of the stand 1. For this purpose, after the bolts 32 have been pulled out, the connecting tops 4, 5 are lifted off in a manner which is not illustrated. The connecting tops 4, 5 are hinged by means of hinges 31 shown in FIGS. 1 and 2 to the free ends of the beams 2*a* and 3*a* of the posts 2, 3 of the rolling mill stand 1 which beams are mounted next to each other. It is also possible, if structural conditions permit, to swing the connecting tops 4, 5 each about one of the bolts 32 toward the outside, so that the path for lifting out the above-described roll set is free.

As shown in FIG. 5, when the lifting girder 16 is lifted, the upper bearing member 14 which has lateral cantilever projections 33 is held by projections 17*a* and 18*a* after it has been moved away from bearing member 15. The projections 17*a*, 18*a* project next to each other into the opening of the U-shaped recess 20. The cantilever projections 33 act from underneath against the projections 17*a* and 18*a*. Instead of the cantilever projections 33, the upper corners of the bearing members can also be used.

After the roll set has been lifted out, this set can be replaced by another roll set which has been prepared for rolling outside of the rolling mill stand 1. Accordingly, the rolling process can be continued immediately after the connecting tops 4, 5 have been reassembled. The duration of the interruption is limited to lifting out the roll sets and replacing them with roll sets which were completely prepared outside of the rolling mill stands.

While a specific embodiment of the invention has been shown and described in detail to illustrate the application of the inventive principles, it will be understood that the invention may be embodied otherwise without departing from such principles.

We claim:

1. A reversible roll stand, comprising:

a plurality of multi-caliber rolls comprising at least a top roll and a bottom roll:

bearing members partially surrounding said rolls;

posts having beams;

windows having tops formed by said beams, wherein said bearing members are adjustably guided in said windows;

connector caps on said beams carrying adjustment elements for the bearing members displaceable for disassembly or removal of the rolls;

a support frame, wherein the rolls with their bearing members are placed and wherein said support frame is insertable and removable through the tops of the windows;

carriers of rolling material guides, wherein said carriers are insertable into said support frame, wherein said support frame, further comprises a pair of U-shaped plates connected with each other in a plane-parallel manner by spacer members, said U-shaped plates defining an aperture and having recesses wherein said rolls with said bearing members projecting outwards on both sides are held in the recesses;

web region of the U-shaped plates, wherein said web region forms a support face for bottom sides of the bearing members of the bottom roll; and opposed pairs of cantilever projections formed in upper portions of each U-shaped plate, wherein said cantilever projections protrude into the aperture for engaging cooperating ledge portions formed in the bearing members of the top roll during roll changes.

2. The reversible roll stand of claim 1, further comprising slotted recesses located opposite each other on both plates of the pair of plates, wherein said slotted recesses permit for displaceable insertion of the carriers of the rolling material guides.

3. The reversible roll stand of claim 1, further comprising lateral extensions attached to the web regions of the U-shaped plates and oriented outwardly thereof, said lateral extensions having upper and lower surfaces, wherein said upper surfaces support the bearing members of the bottom roll, and said lower surfaces rest on parts of the stand defining the windows.

4. The reversible roll stand of claim 3, further comprising slotted recesses located opposite each other on both plates of the pair of plates, wherein said slotted recesses permit for displaceable insertion of the carriers of the rolling material guides.

* * * * *